US006463634B1

(12) United States Patent
Naohara et al.

(10) Patent No.: US 6,463,634 B1
(45) Date of Patent: Oct. 15, 2002

(54) FASTENING BODY MADE OF SYNTHETIC RESIN

(75) Inventors: Masayuki Naohara; Shintaro Oosugi; Mitsuru Akeno, all of Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/521,494

(22) Filed: Mar. 9, 2000

(30) Foreign Application Priority Data

Mar. 1, 1999 (JP) ..... 11-066544

(51) Int. Cl.[7] ..... A44B 18/00

(52) U.S. Cl. ..... 24/444; 24/306; 24/442; 24/452; 428/100

(58) Field of Search ..... 24/306, 442, 444, 24/452; 428/100

(56) References Cited

U.S. PATENT DOCUMENTS 3,391,434 A * 7/1968 Girard ..... 24/444
3,777,435 A * 12/1973 Perina ..... 24/442
4,207,278 A * 6/1980 Cowen et al. ..... 264/46.4
4,233,099 A * 11/1980 McGuire ..... 156/242
4,353,142 A * 10/1982 Nishiyama et al ..... 24/442
4,943,470 A * 7/1990 Shiromizu et al. ..... 428/209
4,969,913 A * 11/1990 Ojima ..... 623/66.1
5,026,588 A * 6/1991 Diekmann ..... 428/100
5,067,210 A * 11/1991 Kayaki ..... 24/452
5,586,595 A * 12/1996 Takizawa et al. ..... 24/306
5,678,286 A 10/1997 Murasaki

FOREIGN PATENT DOCUMENTS

GB 1441328 * 6/1976 ..... 24/444

* cited by examiner

*Primary Examiner*—Victor Sakran
(74) *Attorney, Agent, or Firm*—Finnegan, Henderson, Farabow, Garrett & Dunner, LLP

(57) ABSTRACT

A fastening body having a flat substrate made of synthetic resin. The flat substrate has two synthetic resin layers having different molding shrinkage rates. With the two synthetic resin layers, the flat substrate can have a desired curvature in width direction. The fastening body is fixed by engagement in each of engaging groove portions of a mounting body. The mounting body has a substantially U-shaped section, formed along both side edges in a width direction, so that openings formed by the U-shaped section oppose each other.

6 Claims, 4 Drawing Sheets

FASTENING BODY MADE OF SYNTHETIC RESIN

BACKGROUND OF THE INVENTION

1. Field of the Invention

The present invention relates to a fastening body for fastening various kinds of sheet bodies to a mounting body and a product having the same fastening body, and, more particularly, to a fastening body having a molded fastener structure made of synthetic resin containing a plurality of male engaging elements for use for hanging a curtain, movie screen, back-out curtain, advertisement screen or the like on a hanging portion or for attaching interior materials such as various wall paper and carpet to various kinds of panels or attaching a cleaning body such as mop to a cleaner product.

2. Description of the Related Art

According to a conventionally proposed patent application, for example, when a curtain is attached to a curtain rail having a substantially C-shaped section, a belt-like fastening body for a curtain molded integrally with a flat substrate such that a plurality of synthetic resin male engaging elements like hooks are projected from a surface of the substrate is inserted and fixed to the curtain rail in the length direction thereof. Then, female engaging elements of a surface fastener provided along an upper edge of a curtain are engaged with the fastening body for the curtain having the male engaging elements, so that the curtain is attached to the curtain rail. As disclosed in Japanese Patent Laid-Open Publication No. 9-23906, such a fastening body is used not only for attaching the curtain but also for attaching an interior material such as various wall papers and carpet to various kinds of panels (wall, floor). Recently, the same fastening body has been also used for attaching, for example, a mop or the like to a cleaning tool, so that application field of the fastening body has been expanded.

Usually, the fastening body for use in a curtain or interior material is shaped in a tape which is rather long relative to the width thereof and a curtain rail on which that fastening body is to be attached is also long. Therefore, the fastening body is not attached by being inserted longitudinally, but, by pressing the fastening body against the engagement face of the curtain rail while bending it in the width direction, the right and left longitudinal edges of the fastening body are inserted into the engaging groove portions formed on both the ends in the width direction of the mounting body. Therefore, the fastening body is formed of material relatively likely to be elastically deformed and the flat substrate thereof is formed to be relatively thin. Further, the fastening body to be attached to the curtain rail as described above is demanded in a plane without being curved after it is attached to the curtain rail.

When the aforementioned fastening body is molded as described in FIG. 6 and a description of the aforementioned patent publication, for example, the entire fastening body is often curved in the width direction due to resin material used or thickness of the flat substrate after molding. Therefore, the cavity for molding the fastening body in a die is usually formed in a curved shape corresponding to a degree of the curve, extending in an opposite direction to that curve of the fastening body after molding, in order to keep the fastening body flat without being curved after molding.

On the other hand, the fastening body for use in a cleaning tool is rectangular and in order to prevent it from slipping out of a mounting body because of an external force exerted strongly, the flat substrate is thick and made of material having a relatively high rigidity. Thus, when the fastening body is mounted on the mounting portion of the cleaning tool, it cannot be curved easily unlike the aforementioned case. Thus, the fastening body is inserted into the engaging groove portions formed on the right and left side longitudinal edges of the mounting body and then, a cap is attached to each of both ends in the length direction of the mounting body so that the rectangular fastening body is secured from four sides.

Since conventionally the fastening body of this kind is flat like the fastening body for the curtain, the thickness of the flat substrate of the fastening body is set to substantially the same dimension as a groove width of the engaging groove portion of the mounting body, in order to mount the fastening body onto the mounting body without any clearance. For this reason, the fastening body is very hard to insert into the engaging groove portion of the mounting body.

Thus, in a recent mounting body such as a cleaning mop, the groove width of the engaging groove portion is set larger than the thickness of the fastening body so as to facilitate insertion of the fastening body into the engaging groove portions. Further, plural protruded rows are provided to extend longitudinally on a bottom face which comes into contact with a rear face of the fastening body except the engaging groove portions of the mounting body. Further, the flat substrate of the fastening body is molded such that a side thereof in which the engaging elements are projected is curved so as to be protruded outward. In this case, when the fastening body is inserted into the engaging groove portions, the fastening body does not interfere with the protruded rows. Since this fastening body has a large thickness and high rigidity, it is never deformed or curved after the molding. In order to obtain a curved shape after the molding as described above, it is necessary to form the molding cavity itself in a curved shape.

Such a structure of the mounting body and fastening body is preferable at the time of cleaning, for the cleaning tool, in addition to the aforementioned function. That is, this kind of the cleaning mop is pressed strongly against a floor surface during cleaning and slid violently on the same floor. As a result, when the aforementioned structure is employed, the mop is pressed strongly against the mounting body through the fastening body. By this pressing, the fastening body curved in the width direction is deformed so that it becomes a flat shape. As a result, the both ends in the width direction of the fastening body is pressed strongly to the open wall faces of the engaging groove portions of the mounting body, thereby effectively preventing the fastening body from being removed from the mounting body.

However, not only the fastening body disclosed in the previously mentioned patent application but also the fastening body to be attached to the cleaning tool is desired to be molded so as to be positively curved although the purposes thereof are different. Particularly, improvement of molding technology for this kind of products enables continuous molding of this kind of the fastening body. As a typical molding method, a die wheel having a plurality of cavities for molding engaging elements for a surface fastener on a peripheral face thereof is rotated in a single direction and molten resin is introduced to the peripheral face. As a result, the engaging elements are formed and a flat substrate having a desired thickness is formed integrally. After cooling, that molded product is separated from the wheel surface.

If it is intended to form the flat substrate positively in a curved shape as described above when this molding method is used, the aforementioned die wheel needs to be formed such that the central portion of the body is recessed or projected. Because usually the die wheel is constructed by overlaying a plurality of ring-like thin circular plates, not only a high precision is demanded for that manufacturing but also the manufacturing cost is high.

In case of the fastening body for curtain or the like formed of a single resin material, having a relatively small thickness, when molding condition for resin material, thickness and the like is changed, the curvature of a curved face after molding is changed. Thus, the curvature of the cavity for molding the flat substrate cannot be set constant.

SUMMARY OF THE INVENTION

Accordingly, the present invention has been achieved to solve the above described conventional problem, and therefore, an object of the invention is to provide a fastening body made of synthetic resin formed without carrying out a special processing on a molding die such that it is curved with a desired curvature in the width direction, the fastening body holding a sheet-like body, and a product having the same fastening body.

The above object is achieved by the present invention effectively.

According to the present invention, there is provided a fastening body made of synthetic resin to be fixed by engagement in each of engaging groove portions of a mounting body having a substantially U-shaped section, formed along both side edges in a width direction so that openings thereof oppose each other, so as to attach various sheet-like bodies thereto, wherein the fastening body has a flat substrate having a thickness substantially the same as a groove width of the engaging groove portion and edge portions to be engaged in the engaging groove portions on both side edges in a width direction and a plurality of male engaging elements of a surface fastener, projected integrally from a surface between the edge portions of the flat substrate, and the flat substrate is comprised of two synthetic resin layers having different molding shrinkage rates.

The flat substrate of the fastening body is molded integrally with the engaging elements and is comprised of two layers, front and rear layers, using two kinds of synthetic resin materials having different molding shrinkage rates. Upon this molding, the cavities for molding the fastening body does not need to be formed intentionally in a curved configuration, however, it is formed on the same plane.

That is, when the fastening body for a cleaning mop is formed continuously by means of the aforementioned die wheel, the same die wheel does not need to be formed such that the central portion thereof is dented or projected. This has only to be formed in an ordinary cylinder. The fastening body is made of resin material having a relatively high rigidity and has a larger thickness than the fastening body for curtain or the like. Therefore, when the fastening body is peeled off the die wheel after completion of molding, synthetic resin layer having a higher molding shrinkage rate is contracted more than synthetic resin layer having a lower molding shrinkage rate so that the fastening body is curved in the width direction with a desired curvature based on a difference in the contraction.

When the fastening body is used as a fastening body for the curtain or interior material, it is curved after molding in most cases. Therefore, a synthetic resin layer having a high molding shrinkage rate is disposed on a side by which the curve occurs so as to allow the fastening body to be curved in a direction opposite to the direction of the curve caused by the molding. In this case also, the peripheral face of the die wheel is a mere cylinder, so that, after molding, the fastening body is formed in a flat plane without being curved in the width direction.

Although, as a typical molding method therefor, continuous molding method using the die wheel as described may be employed, it is permissible to use an ordinary injection molding. Typical continuous molding methods will be described.

A plurality of cavities for molding engaging elements are formed in a peripheral face of the die wheel and the die wheel is driven in a single direction. Molten resin extruding dies are disposed upstream and downstream in the rotation direction of the peripheral face of the die wheel such that they oppose the peripheral face of the die wheel. Molten resin of a predetermined width is introduced continuously to the peripheral face of the die wheel from each of the extruding dies under a predetermined resin pressure. A part of molten resin introduced to the upstream is filled in the male engaging elements cavities so as to form the engaging elements and a first layer of the flat substrate having a predetermined thickness is continuously formed with remaining of the same molten resin on the peripheral face of the die wheel. Molten resin introduced to the downstream joins the first layer of the flat substrate so that a second layer is formed integrally.

When synthetic resin materials to be extruded from the aforementioned extruding dies are materials having different molding shrinkage rates, synthetic resin layer formed of a material having a higher molding shrinkage rate is contracted more in the width direction than the other synthetic resin layer to make a curve. The curvature at this time is determined by a difference of molding shrinkage rate between synthetic resin layers. Therefore, a fastening body having a desired curvature in the width direction is formed by selecting material.

To provide with a predetermined flexibility to the flat substrate and facilitate correction of the curvature of such curved configuration, continuous or incontinuous concave grooves are formed between plural male engaging elements along the length direction or the width direction of the flat substrate surface or dented portions are formed intermittently along the engaging edge portions of the flat substrate which engage into the engaging groove portions of the mounting body. Alternatively, the aforementioned engaging edge portion may be formed partially in a wedge shape such that its thickness decreases as it goes toward outside.

Preferably, the synthetic resin layer of the flat substrate disposed on a side from which the engaging elements project is formed of synthetic resin material having a higher molding shrinkage rate than the synthetic resin layer disposed on a side opposite to the side from which the engaging elements project. As a result, in the fastening body after molding, the projection side of the engaging elements is curved so that it is recessed in the width direction. This is preferable for forming a flat shape fastening body having flexibility and a relatively small thickness, which may be applied to fasten a curtain or the like. This fastening body is used by being fitted in a curtain rail.

Alternatively, the synthetic resin layer of the flat substrate disposed on a side from which the engaging elements project is formed of synthetic resin material having a molding shrinkage rate lower than the synthetic resin layer disposed on a side opposite to the side from which the engaging elements project. In this case, to the contrary of the fastening body of the previous paragraph, the fastening body is curved such that the projection side of the engaging elements is protruded in the width direction. Therefore, this is preferable for molding a curved fastening body, which may be applied to fasten the mop or the like. This fastening body is used as being fixed by engagement onto a cleaning tool.

DESCRIPTION OF THE PREFERRED EMBODIMENTS

Figure 1:
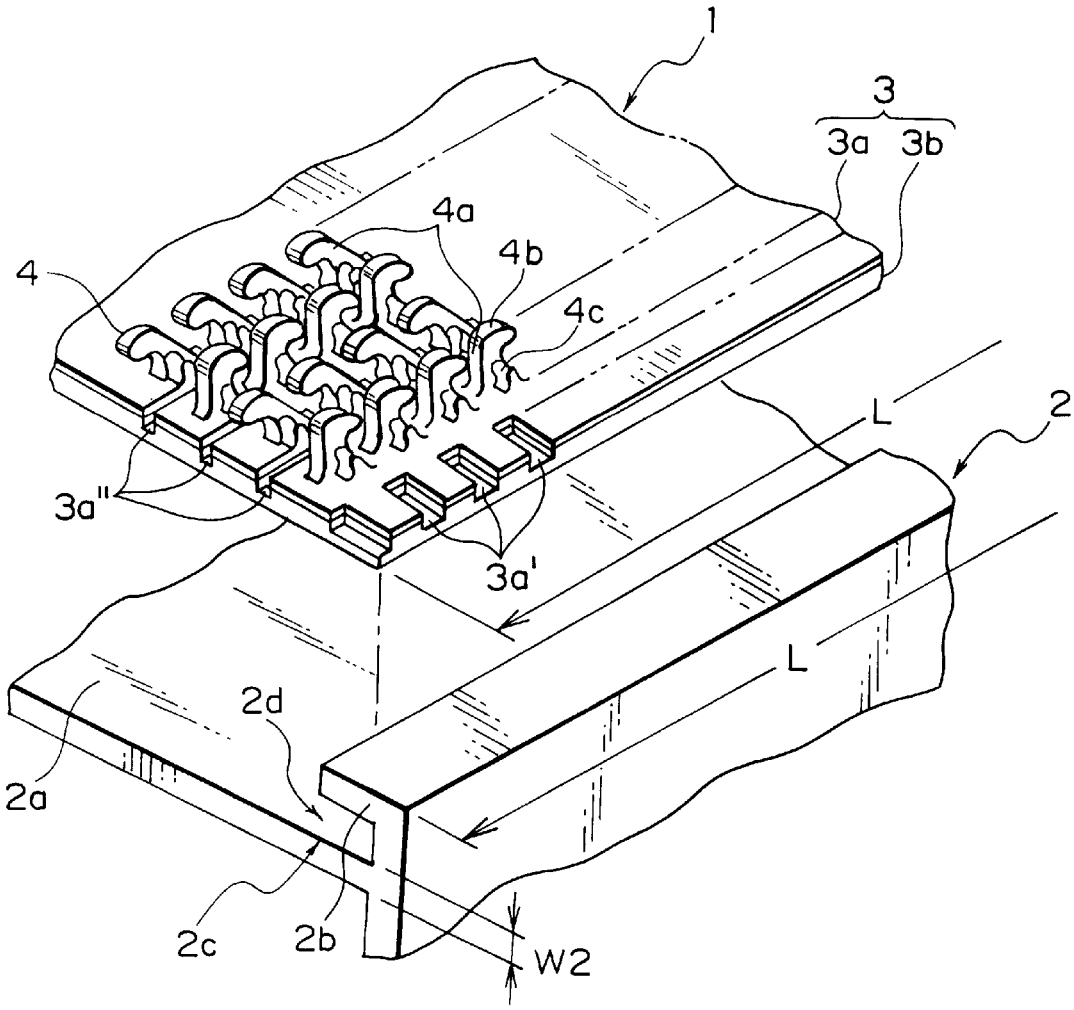
FIG. 1 is an exploded perspective view for showing main part of a structure of a fastening body for a curtain which is a typical embodiment of the present invention and a curtain rail on which the fastening body is to be attached.
Figure 2:
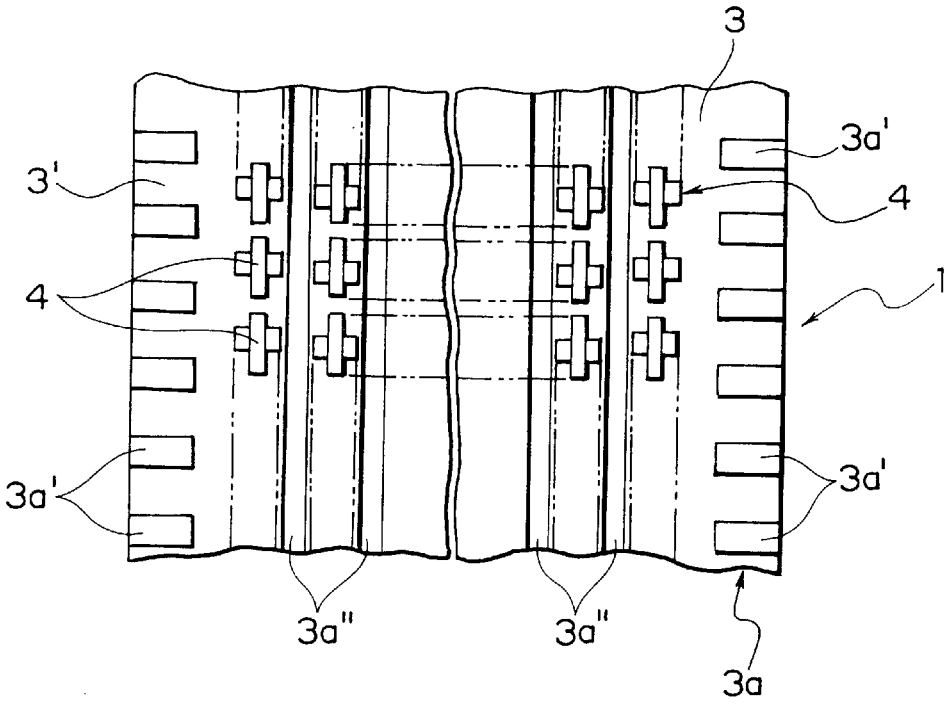
FIG. 2 is a partial plan view of the fastening body for the curtain.
Figure 3:
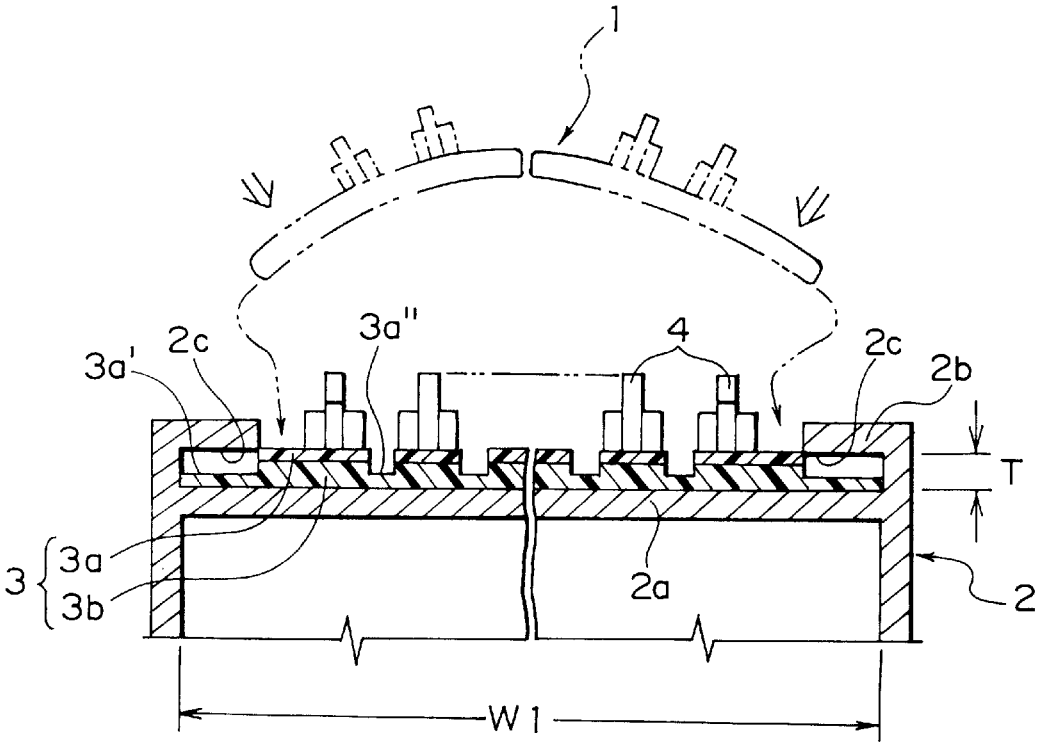
FIG. 3 is a sectional view showing a state in which the fastening body for the curtain is attached and fixed to the curtain rail.

Hereinafter, the preferred embodiments of the present invention will be described with reference to the accompanying drawings. FIG. 1 is an exploded perspective view showing a typical embodiment of the present invention and indicating a mounting state of the fastening body for the curtain on a curtain rail which serves as a mounting body. FIG. 2 is a plan view of the main part of the fastening body for the curtain. FIG. 3 is a lateral sectional diagram showing a mounting state of the fastening body for the curtain.

Referring to these Figures, reference numeral 1 denotes a fastening body for the curtain according to this embodiment and reference numeral 2 denotes a curtain rail as a mounting body of the invention, on which the fastening body 1 for curtain is to be mounted and fixed. This curtain rail 2 is employed in a curtain unit for opening/closing a curtain (not shown), for example. An L-shaped mounting portion 2*b* is extending along each of both side edges in a width direction of a long flat mounting base 2*a* such that openings thereof oppose each other, so that engaging groove portions 2*c* of the fastening body 1 are formed. Such a structure is substantially the same as the conventional mounting body of this kind.

Figure 7:
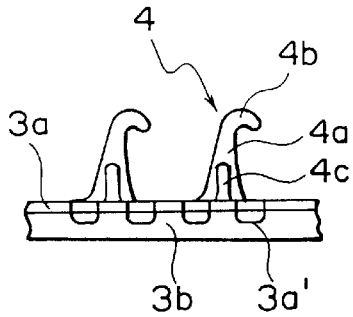
FIG. 7 is a partial side view of the fastening body.

As shown in FIG. 3, the fastening body 1 for curtain has a flat substrate 3 having a length L (FIG. 1) substantially same as that of the curtain rail 2, a width W1 substantially same as a distance of a bottom face between both the engaging groove portions 2*c* and a thickness T substantially same as an opening width dimension W2 (FIG. 1) of the engaging groove portion 2*c* as described above. A plurality of hook-shaped engaging elements 4 are provided centrally on a surface of the flat substrate 3, except both the edge portions 3' (hereinafter referred to as selvages) in the width direction of the flat substrate 3, such that they are molded integrally with the flat substrate 3 so as to protrude. As shown in FIG. 7, this hook-shaped engaging element 4 comprises a rising portion 4*a* rising from the substrate 3 and a curved portion 4*b* which is extended from the rising portion 4*a* in the length direction of the substrate 3 and a front end of which is curved toward the substrate 3. Further, according to the illustrated example, a reinforcement rib 4*c* having a desired height is provided integrally on each side face of the rising portion 4*a*. Of course, the configuration of this hook-shaped engaging element 4 is not restricted to the example shown here, and instead of the hook shape, it is permissible to form an engaging element in the form of a mushroom or having plural curved portions.

The flat substrate 3 according to this embodiment comprises a first synthetic resin layer 3*a* molded with a material having a high molding shrinkage rate and a second synthetic resin layer 3*b* molded with a material having a molding shrinkage rate lower than the first synthetic resin layer 3*a*. According to this embodiment, the first synthetic resin layer 3*a* is disposed on a side of the protrusion of the engaging element 4. Therefore, the engaging element 4 is formed of the same material as the first synthetic resin layer 3*a*.

As described above, according to the invention, it is important to provide the materials of the first synthetic resin layer 3*a* and second synthetic resin layer 3*b* with a difference in molding shrinkage rate. Which molding shrinkage rate of the first synthetic resin layer 3*a* and second synthetic resin layer 3*b* will be set higher is determined appropriately depending on an object on which the fastening body is to be applied. That is, in case of the fastening body 1 for curtain which has a relatively high flexibility and a large thickness, it is likely to be curved or deformed in the width direction so that the protruding face of the engaging elements projects upon molding. Therefore, in order to correct this form into a flat shape, it is necessary to mold the fastening body such that a side in which the engaging elements 4 project is curved to be recessed.

According to the invention, when the first synthetic resin layer 3*a* molded on the side in which the engaging elements 4 project is formed of material having a higher molding shrinkage rate than the material of the second synthetic resin layer 3*b*, the first synthetic resin layer 3*a* is contracted in the width direction based on a difference of the shrinkage rate after molding, even though the fastening body is molded in a flat shape. As a result, that shrinkage force kills a force of the projecting surface which intends to be curved or deformed in the width direction so that a completed product is almost flat.

In case of the fastening body 1 for cleaning mop, which has a high rigidity and a large thickness, usually the fastening body is never curved in the width direction after molding. Therefore, when it is desired to form this kind of the fastening body 1 for mop such that the surface on which the engaging elements projects is curved in the width direction to protrude, the second synthetic resin layer 3*b* on a side opposite to the surface on which the engaging elements 4 project is formed of material having a molding shrinkage rate higher than the first synthetic resin layer 3*a* molded on the side which the engaging elements 4 project from, so that the side opposite to the side which the engaging elements 4 project from is recessed according to a difference of the aforementioned shrinkage rate. Therefore, in this case, even when the fastening body is molded in a flat shape, the fastening body is curved at a predetermined curvature in the width direction after molding.

As the typical synthetic resin material having a high molding shrinkage rate, ethylene base resins such as straight chain polyethylene, high density polyethylene and low density polyethylene can be used. Synthetic resin material having an affinity and a low molding shrinkage rate includes olefin group, particularly polypropylene or polypropylene base adhesive polymer. The molding shrinkage rate of the ethylene base resin material is 0.8 to 2.2%, the molding shrinkage rate of the propylene base resin material is 0.3%. Of course, the present invention is not restricted to these resin materials, and it is possible to use selectively materials having different molding shrinkage rates of the same base resin materials or resin material having an affinity even when the resin material is amide base or ester base thermoplastic resin.

According to this embodiment, like the invention described in Japanese Patent Laid-Open Publication No. 9-23906, the thickness T of the fastening body 1 for curtain is set the same as the width dimension W2 of the engaging groove portion 2*c*. The surface of the selvage 3' on the side which the hook-shaped engaging elements 4 project is not formed only in a mere flat plane, however dented portions 3*a*' are formed intermittently along the length direction thereof, so that the surface thereof is formed in an uneven surface extending continuously along the length direction. When the fastening body having the above tape configuration is formed continuously, generally, if the selvage is formed in a mere flat plane, there is produced undulation in the length direction. Therefore, when the selvage is formed in the mere flat plane, insertion of the selvage of the fastening body 1 through an end face in the length direction of the engaging groove portion 2*c* of the mounting body 2 is very hard. Therefore, according to this embodiment, the surface of the selvage 3' is formed in the uneven surface extending continuously along the length direction, the aforementioned undulation is eliminated.

In this case, the thickness of the flat substrate 3 and the thickness of the selvage 3' can be set equivalent and this thickness can be set to a reasonable thickness which is the same as the groove width of the engaging groove portion 2*c* of the mounting body 2, so that an upper surface of the flat substrate 3 may be set near the height of the engaging groove portion 2*c* of the mounting body 2. This means that the height of the rising portion 4*a* of the male engaging element 4 projecting from the flat substrate 3 is not set higher than required and the curved portion 4*b* surely projects upward from the engaging groove portion 2*c*. As a result, not only the engagement with the mating female engaging element can be obtained securely but also a required engaging strength is obtained.

As shown in FIGS. 1 to 3, concave grooves 3*a*" are formed between adjacent rows of the plural engaging elements 4 provided in the length direction on the surface of the substrate 3 such that the concave grooves 3*a*' extend in the length direction of the substrate 3. This concave groove 3*a*" not only provides with an appropriate ease of deformation when the flat substrate 3 is rigid to some extent but also possesses a function for correcting a curved configuration which occurs in the width direction of the substrate 3 at the time of molding.

Figure 4:
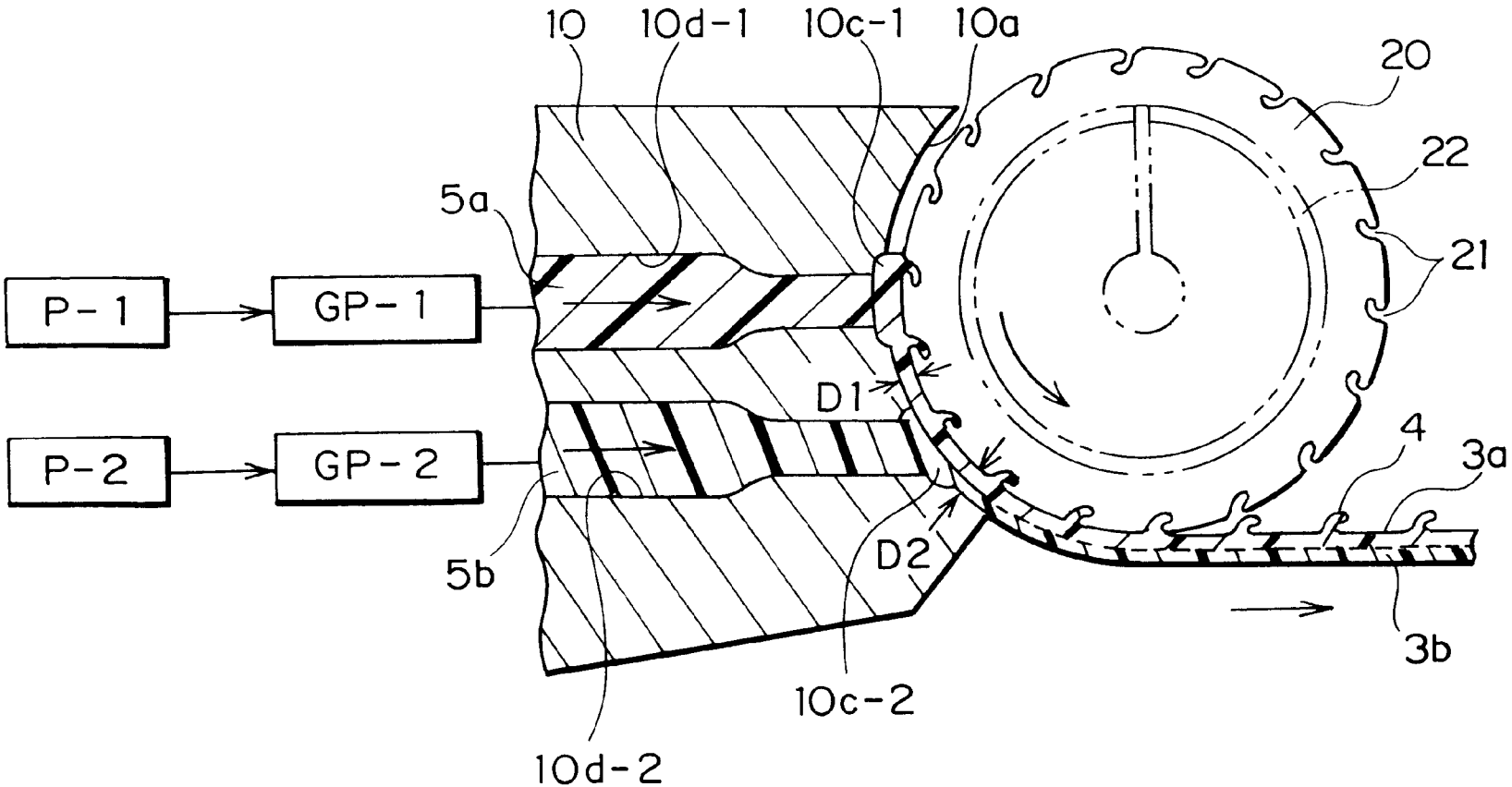
FIG. 4 is a sectional diagram of main part showing an example of a manufacturing apparatus for the fastening body according to the present invention.

FIG. 4 shows an example of structure of main part of a continuous molding apparatus for the fastening body according to the present invention. In this Figure, reference numeral 10 denotes a continuous injection nozzle. A tip of the same nozzle 10 is formed in an arcuate face 10*a* having a predetermined curvature with a gap relative to a periphery of a die wheel 20 which will be described later. A first resin passage 10*d*-1 for supplying first molten resin 5*a* for integrally molding the first resin layer 3*a* provided on a side which the engaging elements 4 of the flat substrate 3 is molded and the engaging elements 4 is formed in an upper portion of the injection nozzle 10, and a second resin passage 10*d*-2 for supplying second molten resin 5*b* for molding the second synthetic resin layer 3*b* to be disposed on a side opposite to the side in which the engaging elements 4 are molded is formed in a lower portion thereof. Two kinds of the molten resins 5*a*, 5*b*, or the first and second molten resins, having different molding shrinkage rates are supplied through the respective resin passages 10*d*-1, 10*d*-2 by respective exclusive gear pumps GP-1, GP-2 with adjustment of the flow rates under a predetermined resin pressure. These resin passages 10*d*-1, 10*d*-2 are open to the arcuate face 10*a*, thereby forming first and second injection ports 10*c*-1, 10*c*-2.

The periphery of the aforementioned die wheel 20 has predetermined gaps D1, D2 with respect to the respective injection ports 10*c*-1, 10*c*-2 of the injection nozzle 10 and an axial line thereof is disposed in parallel to the resin injection ports 10*c*-1, 10*c*-2. As shown in the same Figure, a plurality of cavities 21 for molding the male engaging elements are formed in the peripheral face of the die wheel 20. This die wheel 12 is constructed to have a hollow drum having a water cooling jacket 22 inside thereof and a central portion along the axial line is constructed of a plurality of ring-shaped plates fixed in laminate. Then, the plurality of the male engaging elements molding cavities 21 are provided in the periphery of each of the ring-shaped plates such that they are open to the periphery with the proximal end of the hook located on the peripheral face. The die wheel 20 having such a structure i s rotated in a direction indicated by an arrow by a well known synchronous driving unit. A pair of upper and lower pulling rollers are provided forward of the die wheel 20 and are driven synchronously with a rotation speed of the die wheel 20.

To mold the fastening body 1 of the present invention by means of the above mentioned manufacturing apparatus, two kinds of the molten resins 5*a*, 5*b* having different molding shrinkage rates are injected from the continuous injection nozzles 10 continuously at a predetermined resin pressure and then continuously pressed into a gap formed between the rotating die wheel 20 an d the injection nozzle 10. That is, the first molten resin 5*a* having the higher molding shrinkage rate is filled into each of the male engaging element molding cavities 21 successively along the periphery of the die wheel 20 so as to mold a plurality of the male engaging elements 4. At the same time, the first synthetic resin layer 3*a* of the flat substrate 3 is molded. The second injection port 10*c*-2 is disposed downstream in the rotation direction of the die wheel 20 with respect to the first injection port 10*c*-1. The second molten resin 5*b* having a lower molding shrinkage rate is discharged from the second injection port 10*c*-2 and joins the surf ace of the first molten resin layer 3*a* so as to form the second synthetic resin layer 3*b*.

The fastening body 1 molded along the periphery of the die wheel 20 is cooled from the inside of the die wheel 20 while it is rotated substantially 3/4 turns of the entire periphery of the die wheel 20 so that it is gradually hardened. When the fastening body 1 is removed positively from the die wheel 20 in a horizontal direction by the pulling rollers (not shown) during this hardening, each of the curved portions 4*b* in the cavities 21 is pulled out smoothly from the same cavities 21 with elastic deformation. The curved portion 4*b* is restored to its original shape immediately after it is pulled out of the die wheel 20 and completely hardened, so that the fastening body 1 having a shape shown in FIG. 3 is produced. When the fastening body is cooled and hardened, the first synthetic resin layer 3*a* is contracted in the width direction. Usually, the contraction force is balanced with a force intending to curve toward a side in which the engaging elements 4 project, so that an entirely flat fastening body 1 for curtain is obtained.

According to this embodiment, to peel the fastening body 1 after molding from the die wheel 20, a pair of the upper and lower pulling rollers are used, which rotate synchronously in opposite directions to each other as described above. Although the peripheral face of this pulling roller may be smooth, it is preferable that an annular groove for accommodating the engaging elements 4 is formed in the peripheral portion which the engaging element 4 passes, in order to protect the engaging elements 4 from being damaged. The rotation of the pulling roller is synchronous with that of the die wheel 20 for the engaging element 4 to be pulled out smoothly from the cavity 21.

Figure 5:
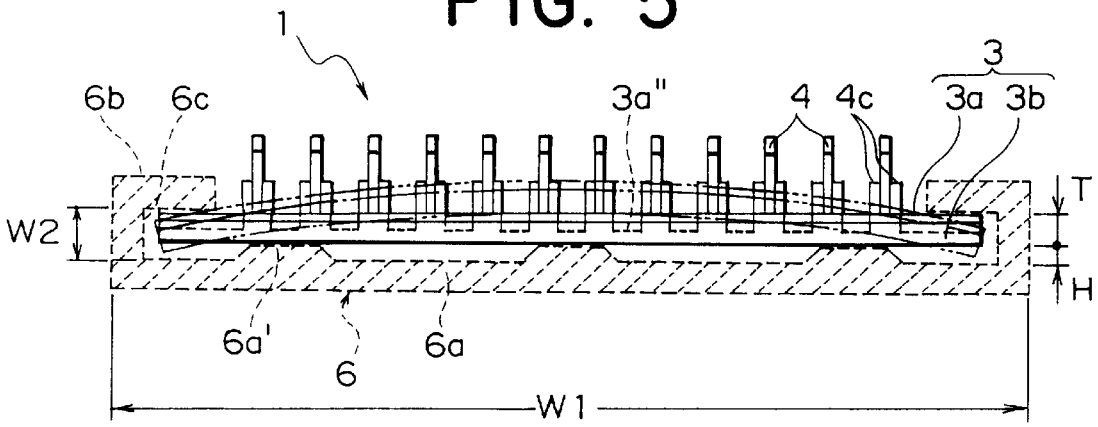
FIG. 5 is a sectional diagram of main part showing an engagement condition between a fastening body for mop and a mounting frame according to a second embodiment of the present invention in use for cleaning.
Figure 6:
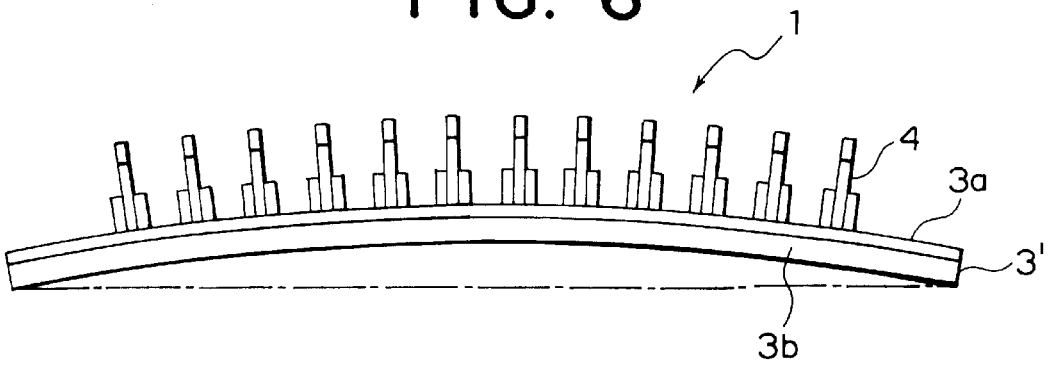
FIG. 6 is a front view showing a usual condition of the fastening body.

FIGS. 5 to 7 show a second embodiment of the present invention. The fastening body of this embodiment is attached to a mounting frame of a cleaning tool so as to hold a cleaning mop. The fastening body for mop of this embodiment is similar in many points to the fastening body 1 for curtain described above except it is different in rigidity, thickness, width and length. Therefore, the fastening body of this embodiment will be described with the same reference numeral 1.

In the same Figures, reference numeral 1 denotes a fastening body for mop according to this embodiment and reference numeral 6 denotes a mounting frame of the cleaning tool on which the fastening body 1 for mop is to be fixed by engagement.

This mounting frame 6 is a generally rectangular flat sheet plate. L-shaped mounting portion 6*b* are extended along a long side edge of a flat plate 6*a* such that their openings oppose each other thereby constructing engaging groove portions 6*c* of the fastening body 1. The selvages of the fastening body 1 for mop are inserted into each of the engaging groove portions 6*c* right and left and engaged therein. When the fastening body 1 for mop is engaged, a cap (not shown) is fixed on each of both end portions in the length direction of the mounting frame 6, so that the fastening body 1 for mop is fixed along its entire edge. According to this embodiment, a plurality of protruded rows 6*a*' are formed so as to be protruded in parallel to each other in the length direction on the fastening body engagement surface of the flat plate 6*a* of the mounting frame 6.

The fastening body 1 for mop has the flat substrate 3 having substantially the same length as the mounting frame 6, a width W1 slightly shorter than a distance on a bottom face between both the engaging groove portions 6*c*, and a thickness T substantially the same as a difference between the opening width dimension W2 of the engaging groove portion 6*c* and a height H of the protruded row 6*a*'. A plurality of the hook-shaped engaging elements 4 molded integrally with the substrate 3 are provided on the surface in the center portion of the flat substrate 3 except both the end portions (selvages) 3' in the width direction thereof. Each of the hook-shaped engaging elements 4 comprises the rising portion 4*a* rising from the substrate 3 and the curved portion 4*b* extended from the rising portion 4*a* in the length direction with its tip being curved toward the substrate 3. Further, as shown in this Figure, the reinforcement rib 4*c* having a desired height is provided integrally on each of the right and left sides of the rising portion 4*a*. The size of the engaging element 4 is larger than that of the previously described embodiment and particularly, the height thereof is by far larger.

According to this embodiment also, the flat substrate 3 comprises two synthetic resin layers. However, according to this embodiment, material of the first resin layer 3*a* has a molding shrinkage rate lower than the second synthetic resin layer 3*b*. Therefore, the engaging element 4 has a molding shrinkage rate lower than the second synthetic resin layer 3*b* and after molding, the configuration of the engaging element 4 is hardly deformed as compared to the second synthetic resin layer 3*b*.

In case of the fastening body 1 for mop which has a high rigidity and a large thickness, usually, it is not curved in the width direction after molding. This kind of the fastening body 1 for mop is sometimes required to be curved positively in the width direction such that a face on which the engaging elements project protrudes as described above. Although in this case, usually the molding cavities are required to be formed so as to have a curved face, according to the present invention, the molding shrinkage rate of resin material for the second synthetic resin layer 3*b* is set to be higher than that of the first synthetic resin layer 3*a* so that the second synthetic resin layer 3*b* molded on an opposite side to the first synthetic resin layer 3*a* is contracted in the width direction. As a result, the opposite side to the side in which the engaging elements 4 are projected is curved such that it is dented. Therefore, in this case, even when the fastening body is formed in a flat shape, the obtained fastening body is curved in a predetermined curvature in the width direction so that the side opposite to the side in which the engaging elements 4 project is recessed.

In the fastening body 1 for mop according to this embodiment, like the above embodiment, the surface of the selvage 3' on the side in which the hook-shaped engaging elements 4 are provided so as to project is not formed in the mere flat plane, however the dented portion 3*a*' is formed intermittently along the length direction so that the surface thereof is formed in an uneven surface continuous in the length direction. Further, as evident from FIG. 5, a plurality of concave grooves 3*a*" are formed intermittently in the length direction of the first synthetic resin layer 3*a* such that they are arranged in parallel in the width direction thereof between the adjacent rows of male engaging elements 4. This concave groove 3*a*" provides with an appropriate ease of deformation when the flat substrate 3 is rigid.

The fastening body 1 for mop having such a structure is fixed to the mounting frame 6 of the cleaning tool by engagement. The engagement is carried out by, first, bringing the recessed side of the fastening body 1 for mop such that it opposes the flat plate 6*a* and then inserting the selvages 3' of the right and left sides of the fastening body 1 for mop into the engaging groove portions 6*c* of the mounting frame 6. When the fastening body 1 for mop is completely engaged into the engaging groove portion 6*c* of the mounting frame, a cap body (not shown) is attached over each of both ends in the length direction of the mounting frame 6 and each of both the ends of the fastening body 1 and the fastening body 1 is fixed with an appropriate fixing means.

When attached, the fastening body 1 for mop is curved like just after molding as shown in FIG. 6. That is, the side of the flat substrate 3 of the fastening body 1 from which the engaging elements 4 project protrudes in the width direction in an opening face of the mounting body 6. Thus, when an engaging element face of a mop (not shown) having a plurality of female engaging elements such as loops is pressed against the engaging element projecting surface of the flat substrate 3, the mating engaging elements engage each other so that the mop is fastened to the fastening body 1.

When cleaning is started with this condition, the mop face (not shown) is pressed against a floor surface strongly, so that the central portion in the width direction of the fastening body 1 is deformed until it comes into contact with the plural protruded rows 6*a*' of the mounting frame 6 and supported thereby. As a result, the selvages 3' of the fastening body 1 for mop come into a firm contact with an inside face of the L-shaped mounting portion 6*b* constituting the engaging groove portion 6*c* of the mounting frame 6. Consequently, the fastening body 1 becomes further unlikely to slip out from the mounting frame 6, so that cleaning work can be done smoothly.

What is claimed is:

1. A fastening body comprising a flat substrate made of synthetic resin to be fixed by engagement in each of engaging groove portions of a mounting body having a substantially U-shaped section, formed along both side edges in a width direction so that openings thereof oppose each other, so as to attach various sheet-like bodies thereto, wherein said flat substrate is comprised of two synthetic resin layers having different molding shrinkage rates.

2. A fastening body made of synthetic resin having a flat substrate and a plurality of male engaging elements, which engage mating loops, projected integrally from a surface of the flat substrate, wherein said flat substrate is comprised of two synthetic resin layers having different molding shrinkage rates.

3. A fastening body made of synthetic resin according to claim 2, wherein the synthetic resin layer of said flat substrate disposed on a side from which said engaging elements project is formed of synthetic resin material having a molding shrinkage rate higher than the synthetic resin layer disposed on a side opposite to the side from which said engaging elements project.

4. A fastening body made of synthetic resin according to claim 2, wherein the synthetic resin layer of said flat substrate disposed on a side from which said engaging elements project is formed of synthetic resin material having a molding shrinkage rate lower than the synthetic resin layer disposed on a side opposite to the side from which said engaging elements project.

5. A curtain rail including a fastening body made of synthetic resin according to claim 3.

6. A cleaning tool including a fastening body made of synthetic resin according to claim 4.

* * * * *